US005749760A

United States Patent [19]

Kimura et al.

[11] Patent Number: 5,749,760

[45] Date of Patent: May 12, 1998

[54] ELECTRON GUN ASSEMBLING APPARATUS AND METHOD OF ASSEMBLING ELECTRON GUN

[75] Inventors: Yasuki Kimura; Takashi Shirase; Masamitsu Okamura; Shuichi Maezono, all of Tokyo, Japan

[73] Assignee: Mitsubishi Denki Kabushiki Kaisha, Tokyo, Japan

[21] Appl. No.: 686,402

[22] Filed: Jul. 25, 1996

[30] Foreign Application Priority Data

Feb. 28, 1996 [JP] Japan ..... 8-041969

[51] Int. Cl.[6] ..... H01J 9/18; H01J 9/42

[52] U.S. Cl. ..... 445/4; 445/3; 445/34; 445/63; 445/67

[58] Field of Search ..... 445/34, 67, 3, 445/4, 63, 64

[56] References Cited

U.S. PATENT DOCUMENTS

| | | | |
|---|---|---|---|
| 4,259,610 | 3/1981 | Takanashi et al. | 445/34 |
| 4,898,559 | 2/1990 | Cote | 445/64 |

FOREIGN PATENT DOCUMENTS

| | | | |
|---|---|---|---|
| 0 296 008 | 12/1988 | European Pat. Off. . | |
| 326440 | 8/1989 | European Pat. Off. | 445/34 |
| 1-227004 | 9/1989 | Japan . | |
| 2-27635 | 1/1990 | Japan . | |
| 3-133023 | 6/1991 | Japan | 445/34 |

OTHER PUBLICATIONS

Patent Abstracts of Japan, vol. 014, No. 170, Mar. 30, 1990 for JP 02 027635 (Jan. 30, 1990).

Patent Abstracts of Japan, vol. 010, No. 035, Feb. 12, 1986 for JP 60 193230 (Oct. 1, 1985).

Patent Abstracts of Japan, vol. 009, No. 274, Oct. 31, 1985 for JP 60 117524 (Jun. 25, 1985).

*Primary Examiner*—P. Austin Bradley
*Assistant Examiner*—Jeffrey T. Knapp
*Attorney, Agent, or Firm*—Burns, Doane, Swecker & Mathis, LLP

[57] ABSTRACT

An electron gun assembling apparatus has a cathode driving mechanism (12,13) for moving a cathode (1), a laser displacement gage (14) to measure a height of a surface of the cathode (1) in a non-contact manner at a cathode surface measuring position outside an electron gun assembly (24), an electric micrometer (11) to measure a height of an upper surface of a first electrode (3) in the electron gun assembly (24), and an electric micrometer (8) to measure a height of a lower surface of a second electrode (4) in the electron gun assembly (24).

19 Claims, 10 Drawing Sheets

$$Z_o = H_o + L_o + T_o + \alpha$$
$$\alpha = Z_o - H_o - L_o - T_o$$

$$Z'_o = h_o + L'_o + t_o + \beta$$
$$\beta = Z'_o - h_o - L'_o - t_o$$

SUBSTITUTING $\alpha = Z_o - H_o - L_o - T_o$

INTO $tG12 = Z_1 - L - H - \alpha$

YIELDS $tG12 = (Z_1 - Z_o) - (L - L_o) - (H - H_o) + T_o$ $$G1K' = (h + \beta) - b$$
$$= \{h + (Z'_o - h_o - L'_o - t_o)\} - (Z_1 - L)$$
$$= (Z'_o - Z_1) - (h_o - h) - (L'_o - L) - t_o$$

POSITION Zm IN Z DIRECTION TO PROVIDE G1Km IS GIVEN BY $$Z_m = Z_2 + (G1K_m - G1K')$$

ELECTRON GUN ASSEMBLING APPARATUS AND METHOD OF ASSEMBLING ELECTRON GUN

BACKGROUND OF THE INVENTION

1. Field of the Invention

The present invention relates to an electron gun assembling apparatus and a method of assembling an electron gun, for positioning and securing a cathode to an electron gun assembly in which a plurality of electrodes are supported by an insulating glass, when assembling the electron gun to be mounted in a cathode-ray tube.

2. Description of the Prior Art

An electron gun serves as a main component part of a cathode-ray tube, and has a cathode, and a structure in which several electrodes for accelerating and converging a cathode-ray radiated from the cathode are supported by an insulating glass at predetermined intervals. In assembly of the electron gun, an interval (G1K interval) between the cathode and a first electrode is important because of its effect on a cut-off voltage characteristic. In the case of, in particular, a color tube having three cathodes R, G, and B in one electron gun, highly accurate assembly is required since a difference in cut-off voltage causes deterioration of white balance and color purity. Therefore, in an electron gun assembling apparatus for positioning and securing the cathode to the electron gun assembly in which all the electrodes except the cathode are assembled, it is required to accurately position and fix the cathode.

FIG. 13 is a schematic diagram showing a conventional electron gun assembling apparatus and a conventional method of assembling an electron gun disclosed in, for example, Japanese Patent Publication (Kokai) No. 2-27635, and FIG. 14 is a sectional view showing a state in which a cathode is attached to an electron gun assembly.

In FIG. 14, reference numeral 1 is a cathode, 2 is a cathode support, 3 is a first electrode, 4 is a second electrode, 5 is a third electrode, 6 is a fourth electrode, and 3a to 6a are electron through-holes in the electrodes 3 to 6. The respective electrodes 3 to 6 and cathode support 2 are supported by an insulating glass 7 at predetermined intervals, thereby forming an electron gun assembly 24.

In FIG. 13, reference numeral 30 is an electron gun assembly holding member including a cylindrical positioning shaft 30A which is inserted into the electron gun assembly 24 to position and align a center of the cathode 1 with centers of the electron through-holes 3a to 6a in the electrodes 3 to 6, and a flange portion 30B used to attach a micrometer 34 described below. Reference numeral 31 is a nozzle inserted into the positioning shaft 30A, and mounted movably in directions of the arrows (x1, y1) through a nozzle driving apparatus 37 such that a distal end 31a thereof can be inserted into or removed from the electron through-hole 4a in the second electrode 4, and the electron through-hole 3a in the first electrode 3. Reference numeral 32 is a cathode holding member, and 33 is a cathode driving unit to drive the cathode holding member 32 when the cathode 1 is positioned and fixed. Reference numeral 34 is the micrometer attached to the flange portion 30B of the electron gun assembly holding member 30, and connected to an arithmetic unit 35, and 36 is an air micrometer connected to the nozzle 31.

A description will now be given of the operation.

Initially, the positioning shaft 30A is inserted into the electron gun assembly 24, thereby positioning and fixedly holding the electron gun assembly 24 at the electron gun assembly holding member 30. In this state, the nozzle 31 is moved by the nozzle driving unit 37 in the direction of the arrow (x1) to insert the distal end 31a of the nozzle 31 into the electron through-hole 4a in the second electrode 4 and the electron through-hole 3a in the first electrode 3.

At the sides of the electron gun assembly 24, there are provided a light source 38 for illuminating a gap between the first electrode 3 and the second electrode 4, and an image processing device 39 for taking a picture of the gap illuminated by the light source 38. When the nozzle 31 passes through the electron through-hole 4a, it is possible to recognize the instant when the distal end 31a of the nozzle 31 exits the electron through-hole 4a in the second electrode 4, and the instant when the distal end 31a enters the electron through-hole 3a in the first electrode 3, by the silhouette of the distal end 31a against the light source 38, which is obtained by the image processing device 39.

In this case, the micrometer 34 converts an amount of movement of the nozzle 31 into electric information to be delivered to the arithmetic unit 35, resulting in completion of measurement of an interval (G12 interval) between the first electrode 3 and the second electrode 4. Subsequently, the arithmetic unit calculates an optimal value L of the interval (G1K interval) between the first electrode 3 and the cathode 1 depending upon the measured G12 interval and the dimensions of other component parts.

On the other hand, the cathode 1 is set in the cathode holding member 32, and is inserted by the cathode driving unit 33 into the cathode support 2. The air micrometer 36 connected to the nozzle 31 measures a distance $L_1$ to the cathode 1 in a non-contact manner. When the distal end 31a of the nozzle 31 is present at a position fed by the nozzle driving unit 37 from the first electrode 3 by $L_2$, the cathode 1 is inserted into the cathode support 2 by the cathode driving apparatus 33 to reach a position at which the measured value $L_1$ of the air micrometer 36 becomes $(L-L_2)$. Finally, the cathode 1 is fixed to the cathode support 2 by methods such as welding, resulting in completion of assembly.

The conventional electron gun assembling apparatus and method of assembling the electron gun are constructed as described above. Consequently, since the image processing is used to recognize the silhouette of the nozzle distal end seen between the first electrode and the second electrode, there is a problem in that the first electrode can be recognized only on the side of the second electrode. The factors that exert a significant influence upon the cut-off voltage characteristic of the electron gun are the distance (G1K interval) between the surface of the first electrode on the side of the cathode and the cathode surface, and the interval (G12 interval) between the first electrode and the second electrode. Since, among the factors, the G1K interval has a particularly significant influence, it is necessary to more exactly measure the G1K interval during assembly than the G12 interval. However, when the first electrode can be recognized only on the side of the second electrode, the distance between the surface of the first electrode on the side of the cathode and the cathode surface can not be set to be an accurate G1K interval by eliminating an effect due to a variation in thickness of the first electrode. Thus, there is a problem in that it is difficult to stably assemble an electron gun having optimal cut-off voltage characteristic.

Furthermore, in the method of recognizing the silhouette of the nozzle by the image processing, there are problems in that a measurement error is easily caused due to, for example, a variation in brightness of the light source caused by a variation in power source voltage, or the life of a lamp, and shadow formed by adhesion of dust, and more time is required for measurement.

Furthermore, in relation to measurement of the cathode surface position, since the electron through-holes in the first and second electrodes are designed to have an extremely small size of several hundreds micrometers as compared with an electron through-hole in another electrode, it is difficult to manufacture a nozzle having a narrower nozzle distal end which can pass through the electron through-holes. Besides, in the narrower nozzle, it is difficult to obtain a sufficient flow rate of air for the air micrometer. Thus, there are problems in that a measuring range becomes very narrow, responsibility and stability of the air micrometer are extremely reduced, and a measurement error is easily caused.

Furthermore, the cathode surface has surface roughness of about 20 μm for $R_{max}$. Therefore, though a substantially mean cathode surface position can be measured in case of a large nozzle diameter, an area serving as a measuring target is more reduced as the nozzle diameter becomes smaller, resulting in occurrence of a variation in measured value. Consequently, there is a problem in that an accurate measurement of the cathode surface position becomes difficult.

Furthermore, as there has been more increasingly desired a high-resolution cathode-ray tube having an excellent focus characteristic, the electron through-holes in the first and second electrodes tend to progressively become smaller. Thus, an electron gun assembling apparatus has been desired using a method other than a method of passing an extra fine air nozzle through holes in electrodes.

SUMMARY OF THE INVENTION

The present invention is made to overcome the above problems, and it is an object of the invention to provide an electron gun assembling apparatus and a method of assembling an electron gun, in which it is possible to rapidly manufacture an electron gun having a stable cut-off voltage characteristic in assembly of an electron gun for use in a high-resolution cathode ray-tube with an excellent focus characteristic, having smaller electron through-holes in first and second electrodes, as well as conventional electron guns for cathode-ray tube.

In accordance with one aspect of the present invention, there is provided an electron gun assembling apparatus comprising: an electron gun assembly holding mechanism for holding an electron gun assembly including at least first and second electrodes which are supported by an insulating glass and are arranged vertically at a predetermined interval; a cathode holding mechanism for holding a cathode to be incorporated into the electron gun assembly; a cathode driving mechanism for moving the cathode holding mechanism to transport the cathode until the cathode is mounted in the electron gun assembly; a cathode surface measuring device for measuring a position of a surface of the cathode which is held by the cathode holding mechanism and is located outside the electron gun assembly; a first electrode upper surface measuring device for measuring a position of an upper surface of the first electrode in the electron gun assembly held by the electron gun assembly holding mechanism; a second electrode measuring device for measuring a position of the second electrode in the electron gun assembly held by the electron gun assembly holding mechanism; a cathode position measuring device for measuring a variation in position of the surface of the cathode held by the cathode holding mechanism carried by the cathode driving mechanism; an arithmetic device for determining an interval between the first electrode and the second electrode in the electron gun assembly on the basis of at least position information obtained by the first electrode upper surface measuring device and the second electrode measuring device, and a measured and known thickness of the first electrode, and for calculating an optimal value of an interval between the first electrode and the cathode, which depends on the interval between the first electrode and the second electrode; and a control device for determining a current position of the surface of the cathode from the position of the surface of the cathode measured by the cathode surface measuring device and a variation in position of the surface of the cathode obtained by the cathode position measuring device, and for controlling the cathode driving mechanism to insert the cathode into the electron gun assembly until a difference between the current position of the cathode surface and the position of the first electrode upper surface reaches the optimal value calculated by the arithmetic device.

In a preferred embodiment of the present invention, the second electrode measuring device is adapted to measure a position of a lower surface of the second electrode, and the arithmetic device determines the interval between the first electrode and the second electrode in the electron gun assembly on the basis of position information obtained by the first electrode upper surface measuring device and the second electrode measuring device, and measured and known thicknesses of the first and second electrodes.

The electron gun assembling apparatus can comprise a supporting body, which is driven by the cathode driving mechanism, for supporting the first electrode upper surface measuring device and cathode holding mechanism.

Preferably, the cathode position measuring device is adapted to measure a position of the supporting body.

In a preferred embodiment of the present invention, the electron gun assembling apparatus further comprises a reference jig mechanism for determining a relationship between measured values obtained by the first electrode upper surface measuring device, the second electrode measuring device, the cathode surface measuring device, and the cathode position measuring device to calibrate these measuring devices, and a reference jig driving mechanism for moving the reference jig mechanism between measuring positions where the reference jig mechanism is measured by the plural measuring devices and standby positions where the reference jig mechanism is apart from the plural measuring devices. Preferably, the reference jig mechanism includes a first reference jig with a predetermined thickness for determining a relationship between measured values obtained by the first electrode upper surface measuring device, the second electrode measuring device and the cathode position measuring device, and a second reference jig with a predetermined thickness for determining a relationship between measured values obtained by the cathode surface measuring device and the cathode position measuring device.

In a preferred embodiment of the present invention, each of the first electrode upper surface measuring device and the second electrode measuring device is an electric micrometer with a probe, a distal end of which is formed to have a convex curved surface. Preferably, the probe distal end of each of the electric micrometers has a radius of curvature of 20 mm or more, and a contact force of 20 g or less during measurement.

In a preferred embodiment of the present invention, the electron gun assembly holding mechanism has a positioning shaft which is inserted into electron through-holes in the electron gun assembly, and into which the probe of the electric micrometer serving as the second electrode measuring device can be inserted.

In a preferred embodiment of the present invention, the cathode surface measuring device is a laser displacement gage. Furthermore, the cathode driving mechanism can be adapted to move the cathode holding mechanism to enable scanning of a measuring position on the cathode surface when the position of the surface of the cathode is measured by the laser displacement gage. Alternatively, the laser displacement gage can be adapted to scan a measuring position on the surface of the cathode when measuring the position of the surface of the cathode.

In a second aspect of the present invention, there is provided a method of assembling an electron gun, for positioning and fixing a cathode to an electron gun assembly in which at least first and second electrodes are supported by an insulating glass and are arranged at a predetermined interval, the method comprising the steps of: measuring a position of a surface of the cathode at a cathode surface measuring position outside the electron gun assembly; measuring a position of an upper surface of the first electrode in the electron gun assembly; measuring a position of the second electrode in the electron gun assembly; determining an interval between the first electrode and the second electrode in the electron gun assembly on the basis of at least the measured positions of the upper surface of the first electrode and the second electrode, and a measured and known thickness of the first electrode; calculating an optimal value of an interval between the first electrode and the cathode, which depends on the interval between the first electrode and the second electrode; moving the cathode from the cathode surface measuring position to a cathode assembling position where the cathode is incorporated into the electron gun assembly; determining a current position of the surface of the cathode from the position of the surface of the cathode at the cathode surface measuring position and a variation in position of the surface of the cathode which is caused by a movement of the cathode to the cathode assembling position; and positioning and fixing the cathode by inserting the cathode into the electron gun assembly until a difference between the current position of the cathode surface and the position of the first electrode upper surface reaches the optimal value calculated.

In a preferred embodiment of the present invention, the measurement of the position of the second electrode is performed by measuring a lower surface of the second electrode, and the interval between the first electrode and the second electrode in the electron gun assembly is determined on the basis of the positions of the upper surface of the first electrode and lower surface of the second electrode, and measured and known thicknesses of the first and second electrodes.

In a preferred embodiment of the invention, a calibration is periodically made to obtain a relationship between measured values in the steps for measuring the positions of the upper surface of the first electrode, the second electrode, and surface of the cathode at the cathode surface measuring position.

Preferably, a contact type electric micrometer is used to measure the position of the upper surface of the first electrode and position of the second electrode in the electron gun assembly.

In a preferred embodiment of the invention, a laser displacement gage is used to measure the position of the surface of the cathode at the cathode surface measuring position. Furthermore, the surface of the cathode can be scanned at a time of measurement by the laser displacement gage, and a value statistically found from an aggregation, of measured values obtained by the scanning can be defined as the position of the surface of the cathode. Preferably, a mean value can be used as the value statistically obtained from the aggregation of the measured values.

Furthermore objects and advantages of the present invention will be apparent from the following description of the preferred embodiments of the invention as illustrated in the accompanying drawings.

DETAILED DESCRIPTION OF THE PREFERRED EMBODIMENT

A description will now be given of one embodiment of the present invention.

Figure 1:
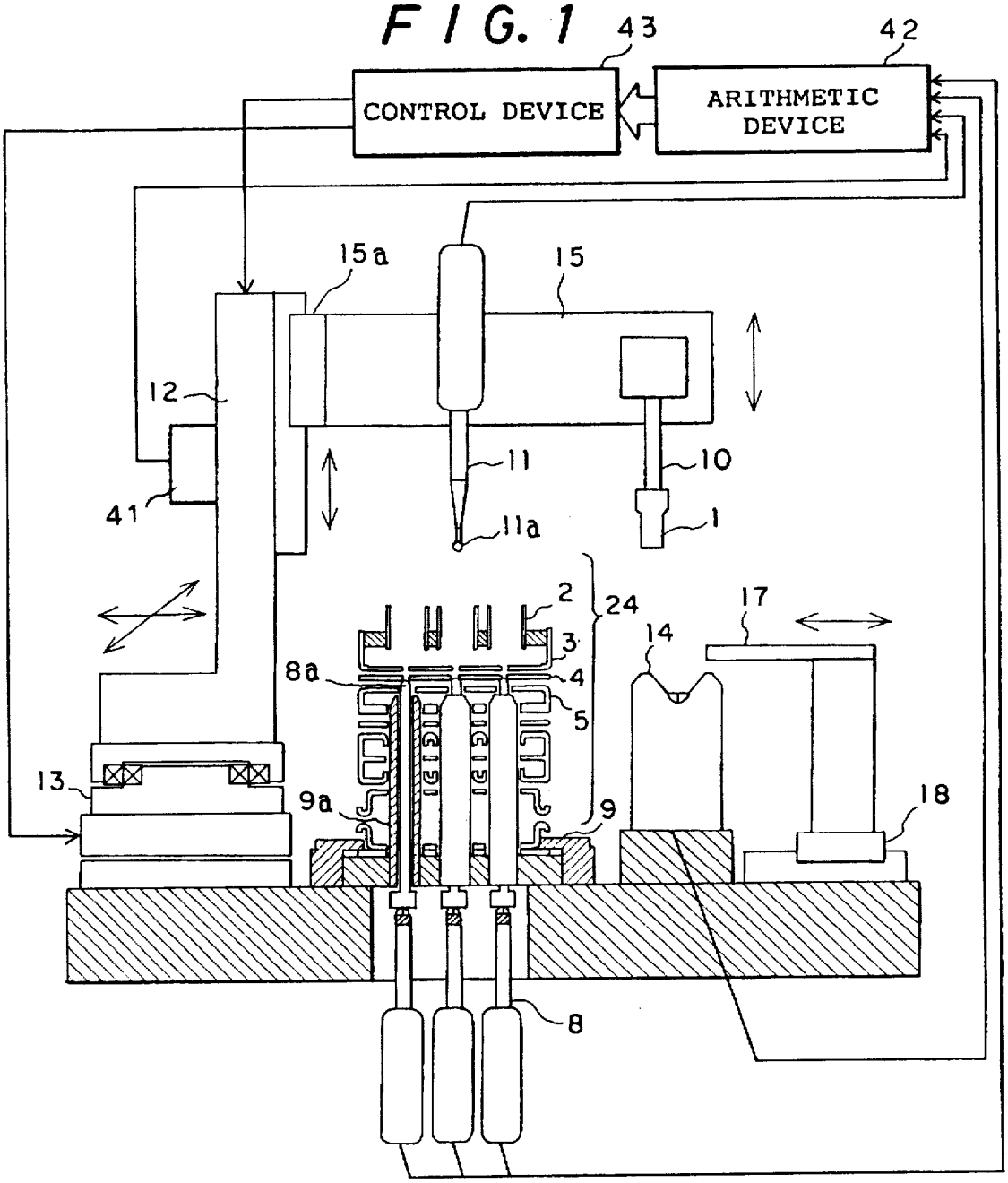
FIG. 1 is a schematic diagram showing the structure of an electron gun assembling apparatus according to an embodiment of the present invention, and a holding state of an electron gun assembly.

FIG. 1 is a schematic diagram showing the structure of an electron gun assembling apparatus according to this embodiment of the present invention, and a state in which an electron gun assembly is supported. In the drawing, reference-numeral 1 denotes a cathode, 2 is a cathode support, 3 is a first electrode, 4 is a second electrode, and 5 is a third electrode, all of which, except the cathode 1, are assembled into an electron gun assembly 24 with the respective electrodes 3 to 5 and cathode support 2 supported by an unillustrated glass at predetermined intervals, and are attached to the electron gun assembling apparatus.

Reference numeral 8 denotes an electric micrometer (second electrode measuring device) for measuring a lower surface position of the second electrode 4, 8*a* is a probe of the electric micrometer 8, 9 is an electron gun assembly holding mechanism for holding the electron gun assembly 24, 9*a* is a positioning shaft mounted on the electron gun assembly holding mechanism 9, 10 is a cathode holding mechanism for holding the cathode 1, and 11 is an electric micrometer (first electrode upper surface measuring device) including a probe 11*a* at a distal end thereof, for measuring an upper surface position of the first electrode 3. The cathode holding mechanism 10 and electric micrometer 11 are supported by a common supporting body 15. Reference numeral 12 denotes a vertically driving mechanism (cathode driving mechanism) for vertically driving the supporting body 15, and 13 is an XY driving mechanism (cathode driving mechanism) for driving the vertically driving mechanism 12 in XY directions. The cathode holding mechanism 10 and electric micrometer 11 are adapted to move in XYZ directions. Reference numeral 14 denotes a laser displacement gage (cathode surface measuring device) for measuring the position of a surface of the cathode 1 to be incorporated into the electron gun assembly 24 at a cathode surface measuring position in a non-contact manner so as to avoid damage to the surface of the cathode 1. Reference numeral 15 denotes a supporting body to support the cathode holding mechanism 10 and electric micrometer 11, and 15*a* is a guide mounted on the supporting body 15. The supporting body 15 is driven by the vertically driving mechanism 12 through sliding guide of the guide 15*a*. Furthermore, reference numeral 41 denotes a support body height measuring device (cathode position measuring device) for measuring the height of the supporting body 15 driven by the vertically driving mechanism 12, 42 denotes an arithmetic device for determining an interval between the first and second electrodes 3 and 4 on the basis of the position information obtained by the electric micrometers 8 and 11, and the measured and known thicknesses of the first and second electrodes 3 and 4, and for calculating an optimal value of an interval between the first electrode 3 and the cathode 1, which depends on the interval between the first and second electrodes 3 and 4, and 43 denotes a control device for determining a current position of the surface of the cathode 1 from the position of the surface of the cathode at the cathode surface measuring position measured by the laser displacement gage 14 and a variation in the position of the surface of the cathode 1 obtained by the support body height measuring device 41, and for controlling the cathode driving mechanism 12 to insert the cathode 1 into the electron gun assembly 24 until a difference between the current position of the cathode surface and the position of the first electrode upper surface obtained by the electric micrometer 8 reaches the optimal value calculated by the arithmetic device 42.

Figure 2:
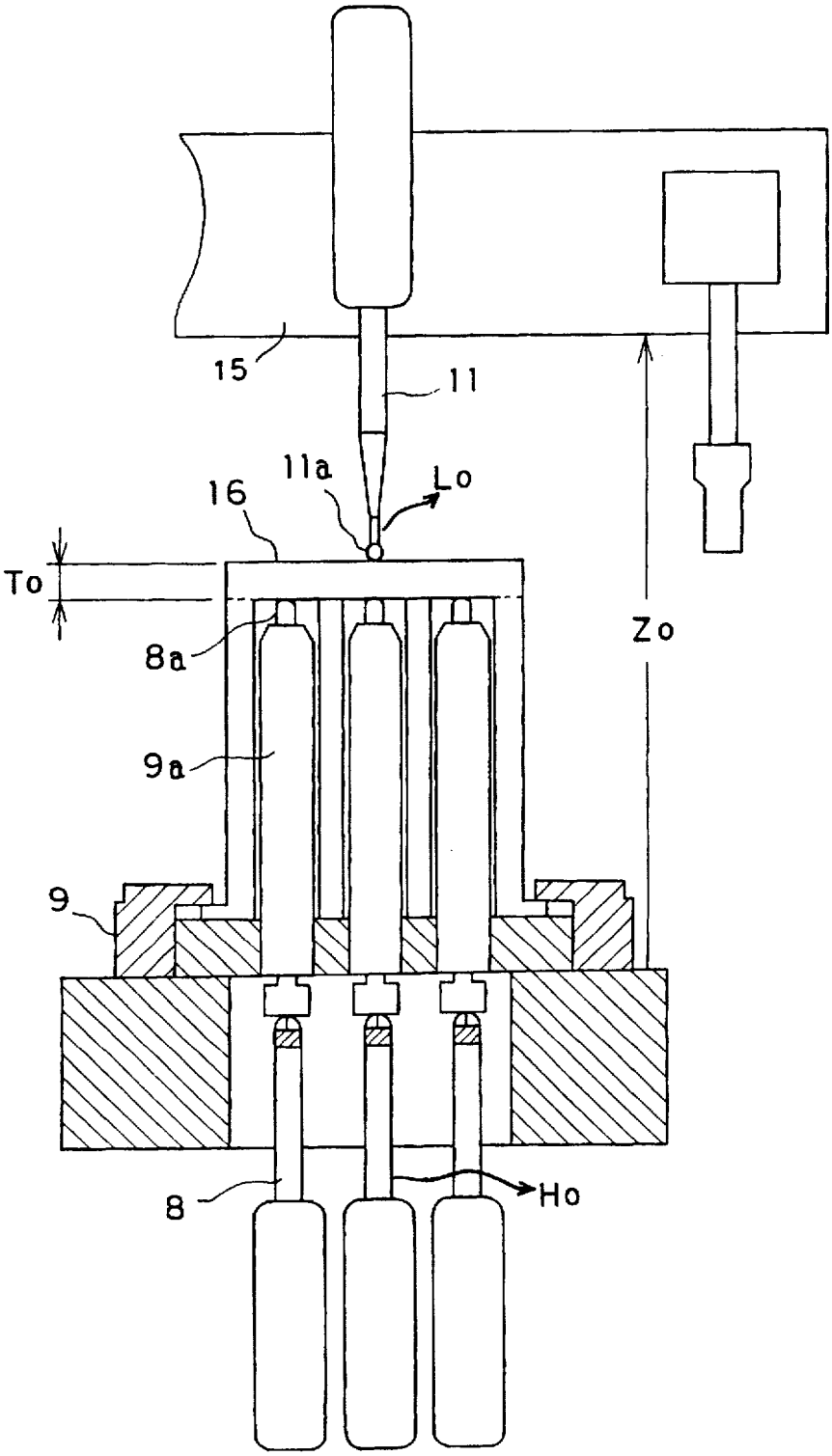
FIG. 2 is a schematic diagram showing measurements of reference values of electric micrometers according to the embodiment of the present invention.

In FIG. 2, reference numeral 16 denotes a first reference jig having a known thickness $T_o$. Turning back to FIG. 1, reference numeral 17 denotes a second reference jig having a known thickness $t_0$, and 18 is a driving mechanism (reference jig driving mechanism) for supporting the second reference jig 17, and horizontally moving the reference jig 17 between a measuring position where the reference jig 17 is measured by the laser displacement gage 14 and a standby position where the reference jig 17 is away from the laser displacement gage 14.

In the electron gun assembly 24 formed by assembling all the electrodes except the cathode 1, the electrodes are assembled with the center positions of the electron through-holes aligned. As shown in the drawing, the electron gun assembly 24 is fixed by the electron gun assembly holding mechanism 9 with the positioning shaft 9*a* inserted into the electron through-holes in the electrodes except the first electrode 3 and second electrode 4. The probe 8*a* of the electric micrometer 8 is disposed inside the positioning shaft 9*a* so that the lower surface position of the second electrode 4 is measured by the electric micrometer 8, and the upper surface position of the first electrode 3 is measured by the electric micrometer 11. The probe 8*a* of the electric micrometer 8 and probe 11*a* of the electric micrometer 11 are provided with distal ends having a radius of curvature of 20 mm or more, for example, spherical distal ends having a radius of 30 mm. Furthermore, the measurement is made with a contact force of 20 g or less acting on the electrodes during the measurement. Setting the radius of curvature and contact force of the probe distal ends in the above ranges makes it possible to measure the positions of the electrodes in a contact manner with surface pressure set in such a range that the probe distal ends don't scratch the surfaces of the electrodes, and hence make the position measurement in the contact manner without damage to the electrodes.

It is to be noted that in this embodiment, calculations are carried out by the arithmetic device 42 including, for example, a CPU, a memory, and so on, and the vertically driving mechanism, the XY driving mechanism, and so forth, are controlled by the control device 43 including, for example, the CPU, memory, and so on. It must be noted that the arithmetic device 42 and control device 43 should not be constructed separately, and can be formed in one unit. Furthermore, it is to be noted that the "upper surface" of the electrode means a surface of each electrode on the side of the cathode, and the "lower surface" means a surface opposite to the upper surface.

A description will now be given of the operation.

Initially, before a description of an actual assembling operation, a description will be given of the act of storing reference values for measurements of the electric micrometer 8, electric micrometer 11, laser displacement gage 14, and supporting body height measuring device 41 in order to determine relative deviation in position between the measuring devices 8, 11, 14, and 41, i.e., a relationship between measurement values obtained by these measuring devices to calibrate the measuring devices.

FIG. 2 shows a schematic diagram showing the measurements of the reference values of the electric micrometer 8 and electric micrometer 11 using the first reference jig 16. The reference jig 16 having the known thickness $T_o$ is moved to the position of the electron gun assembly holding mechanism 9, i.e., a measuring position by an unillustrated driving device (reference jig driving mechanism), and is held by the electron gun assembly holding mechanism 9. At this time, the probe 8*a* of the electric micrometer 8 disposed inside the positioning shaft 9*a* is brought into contact with a lower surface of the reference jig 16. Subsequently, the electric micrometer 11 is moved to a position above the reference jig 16 by the vertically driving mechanism 12 and XY driving mechanism 13, thereby bringing the probe 11*a* into contact with an upper surface of the reference jig 16.

Then, a measured value $L_0$ of the electric micrometer 8, a measured value $H_0$ of the electric micrometer 11, and a position $Z_0$ of the supporting body 15 driven by the vertically driving mechanism 12 at this moment are respectively stored in the arithmetic device 42.

Figure 3:
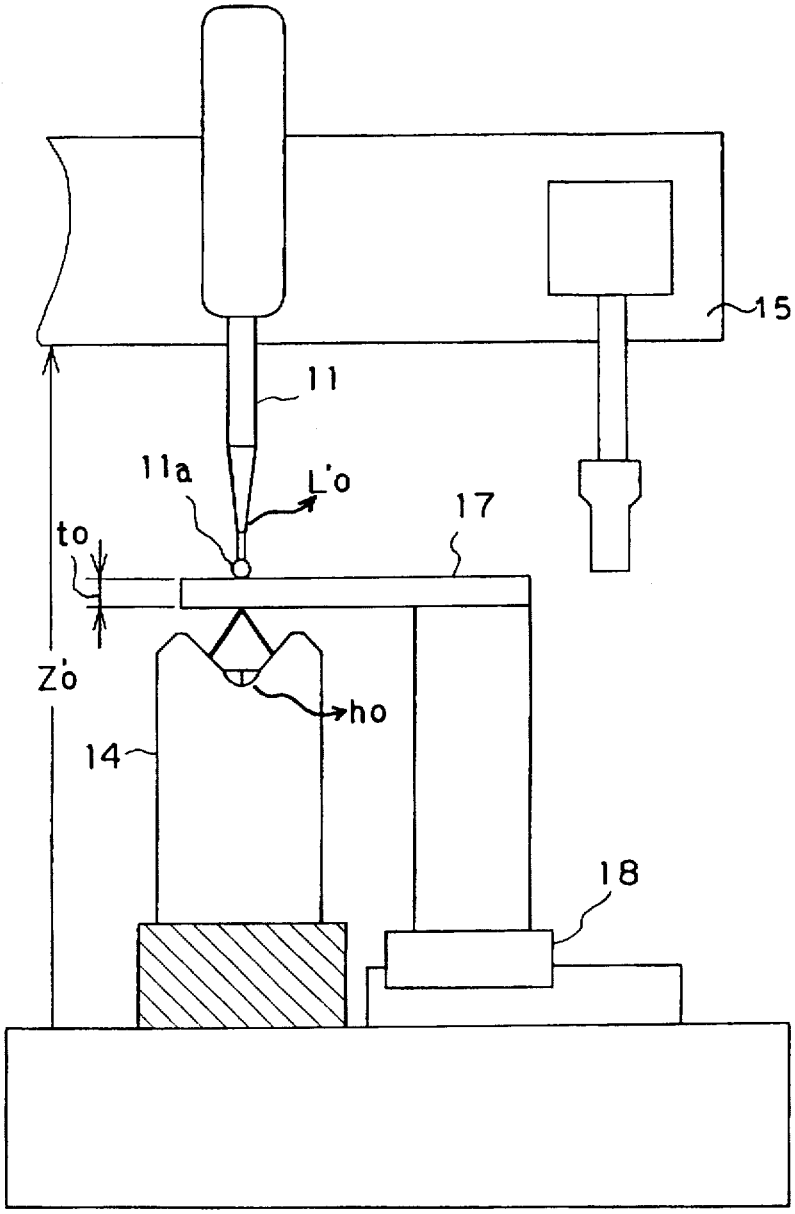
FIG. 3 is a schematic diagram showing measurements of reference values of the electric micrometer and a laser displacement gage according to the embodiment of the present invention.

FIG. 3 is a schematic diagram showing measurements of reference values of the electric micrometer 11 and the laser displacement gage 14 using the second reference jig 17. The reference jig 17 having the known thickness $t_0$ is supported by the driving mechanism 18 movably mounted in a horizontal direction, and is moved to the measuring position immediately above the laser displacement gage 14 by the driving mechanism 18. Next, the electric micrometer 11 is moved to a position above the reference jig 17 by the vertically driving mechanism 12 and the XY driving mechanism 13, thereby bringing the probe 11*a* into contact with an upper surface of the reference jig 17. Then, a measured value $L_0'$ of the electric micrometer 11, a measured value $h_0$ of the laser displacement gage 14, and a position $Z_0'$ of the supporting body 15 driven by the vertically driving mechanism 12 at this moment are respectively stored in the arithmetic device 42.

After the storage of the reference positions obtained by using the reference jigs as described above is completed, the arithmetic device 42 determines relationships between the measured values of the measuring devices, i.e., the electric micrometer 8, electric micrometer 11, laser displacement gage 14, and supporting body height measuring device 41. The relationships are given by the following expressions:

$$Z_0=H_0+L_0+T_0+\alpha \quad (1)$$

$$Z_0'=h_0+L_0'+t_0+\beta \quad (2)$$

Figure 4:
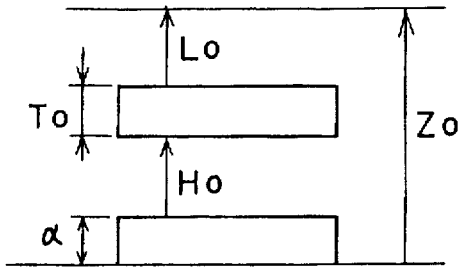
FIG. 4 is an explanatory view diagrammatically showing a relationship between the reference values shown in FIG. 2.
Figure 5:
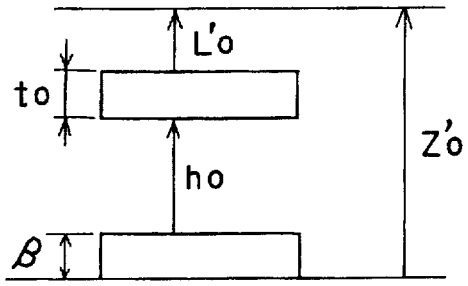
FIG. 5 is an explanatory view diagrammatically showing a relationship between the reference values shown in FIG. 3.

FIGS. 4 and 5 are explanatory views diagrammatically showing relationships between the measured values shown in FIGS. 2 and 3. Here, $\alpha$ and $\beta$ are constants which represent relative deviation in position between the measuring devices 8, 11, 14, and 41, which depend on thermal expansion of the measuring devices and other components supporting the devices caused by heat evolution of the apparatus itself, and a variation in ambient temperature. The constants which show the relationships between measurement values by the measuring devices are varied according to so-called temperature drift. Hence, even when the electron gun assembling apparatus is successively operated to assemble in actuality, the act of storing the reference values of the measuring instruments is preferably carried out periodically (for example, per hour) to update $\alpha$ and $\beta$ so as to keep an assembling accuracy.

A description will now be given of the actual assembling operation.

Figure 6:
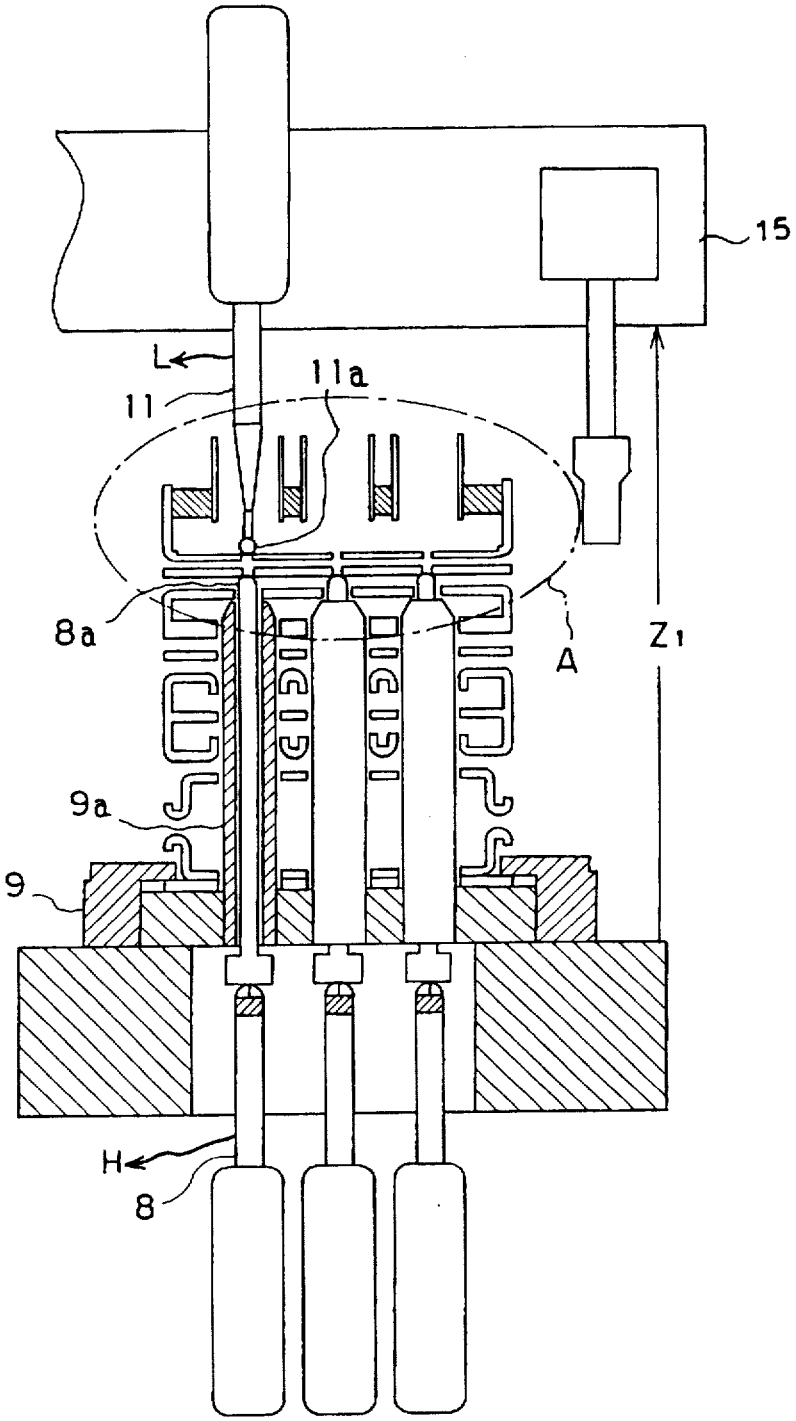
FIG. 6 is a schematic diagram showing the act of measuring a first electrode and a second electrode according to the embodiment of the present invention.
Figure 7:
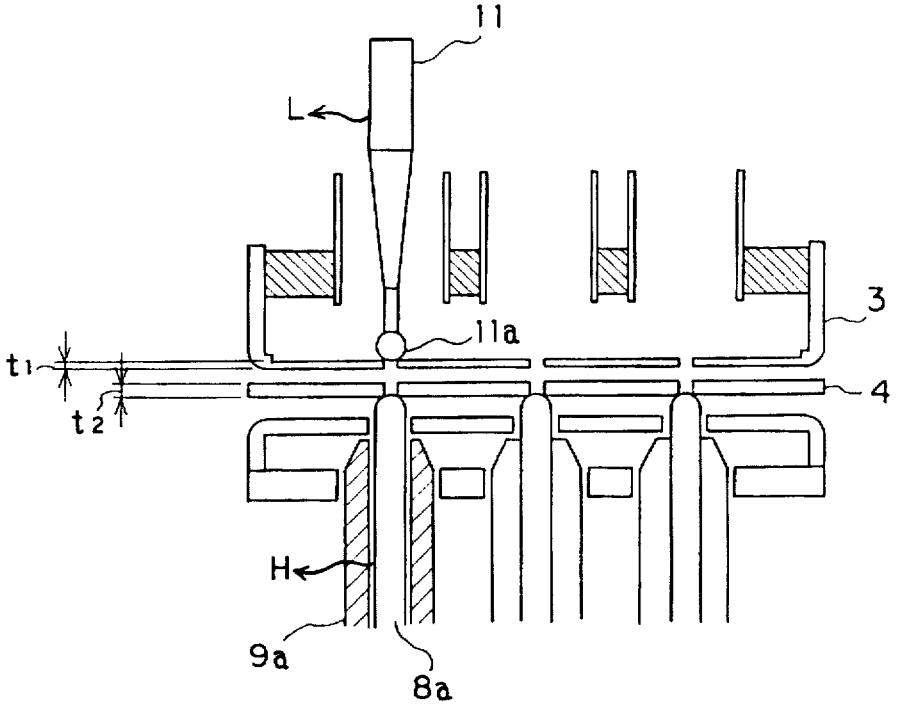
FIG. 7 is an enlarged view of an A portion of FIG. 6.

FIG. 6 is a schematic diagram showing the act of measuring the positions of the first electrode 3 and second electrode 4, and FIG. 7 is an enlarged view of an A portion thereof. Initially, the electron gun assembly 24 is fed to the electron gun assembly holding mechanism 9 by an unillustrated feeding apparatus, and is fixed by the electron gun assembly holding mechanism 9. At this time, as shown in FIG. 7, the probe 8*a* of the electric micrometer 8 disposed inside the positioning shaft 9*a* is brought into contact with the lower surface of the second electrode 4. Subsequently, the electric micrometer 11 is moved by the vertically driving mechanism 12 and XY driving mechanism 13 so that the probe 11*a* passes through a hole in the cathode support 2 to contact the upper surface of the first electrode 3. Then, a measured value H of the electric micrometer 8, a measured value L of the electric micrometer 11, and a position $Z_1$ of the vertically driving mechanism 12 at this moment are stored in the arithmetic device 42.

Figure 8:
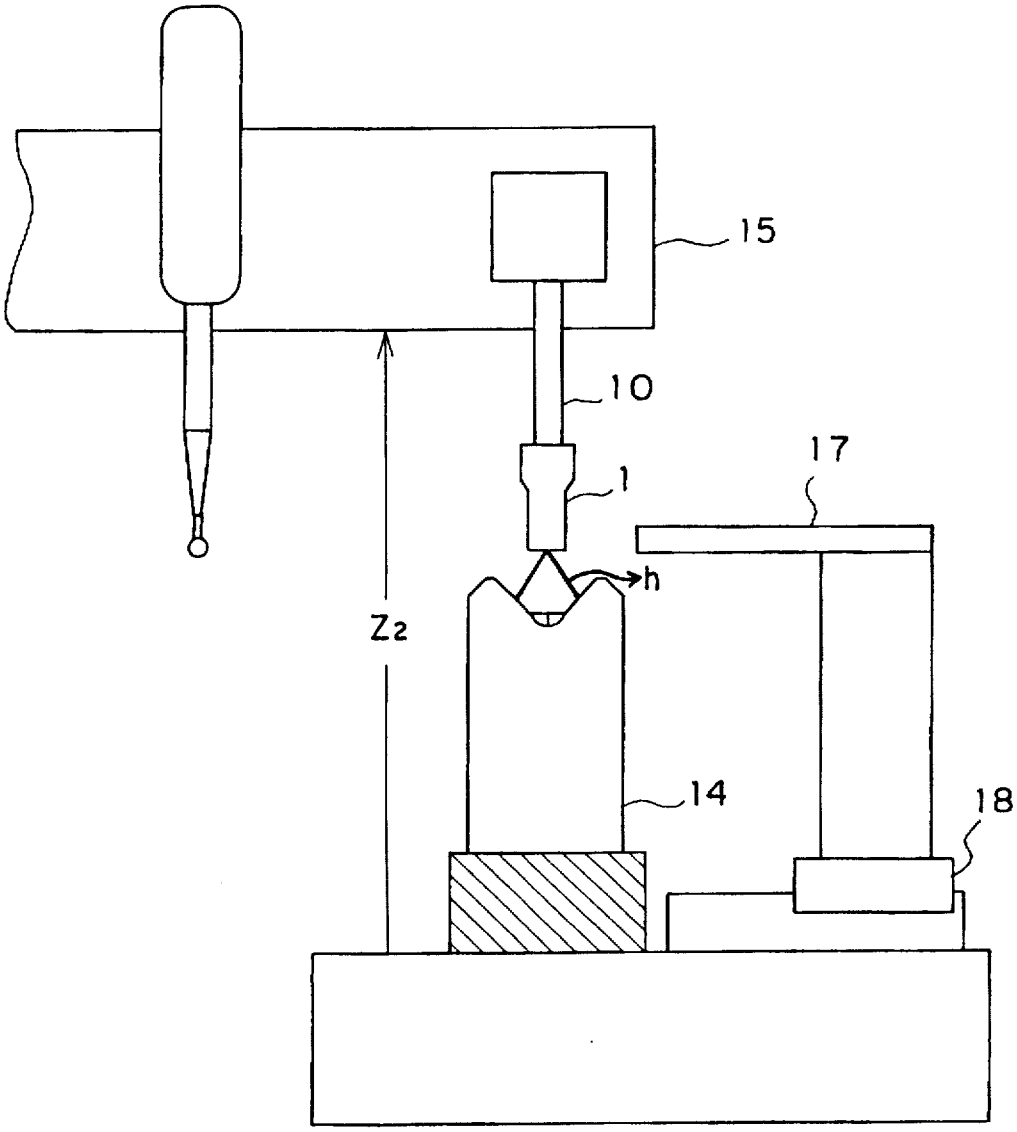
FIG. 8 is a schematic diagram showing the act of measuring a cathode surface position according to the embodiment of the present invention.

FIG. 8 is a schematic diagram showing the act of measuring the position of a surface of the cathode. Initially, the cathode holding mechanism 10 is moved to an unillustrated cathode feeding position by the vertically driving mechanism 12 and XY driving mechanism 13, and then the cathode 1 is fixed to the cathode holding mechanism 10. Subsequently, the cathode holding mechanism 10 holding the cathode 1 is moved to a position above the laser displacement gage 14. At this time, as shown in FIG. 8, the reference jig 17 is moved to the standby position where it is away from the cathode holding mechanism 10 and cathode 1. Thereafter, a measurement is repeatedly made by the laser displacement gage 14, and the cathode 1 is repeatedly moved by a microscopic distance by drive of the XY driving mechanism 13, thereby scanning the surface of the cathode 1 at a position thereof measured by the laser displacement gage 14. It is thereby possible to obtain many measured values of height in a wide range of the surface of the cathode 1. A mean value of the many measured values is defined as a surface position h of the cathode 1, which is stored in the arithmetic device 42 together with a position $Z_2$ of the vertically driving mechanism 12.

Figure 9:
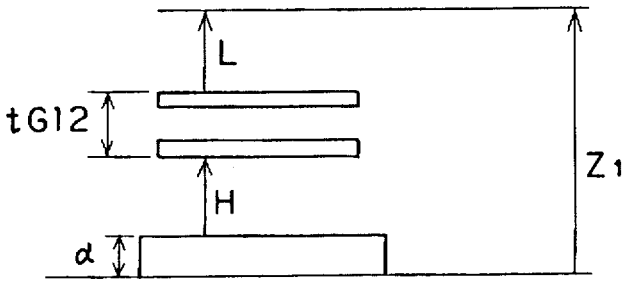
FIG. 9 is an explanatory view diagrammatically showing a relationship between measured values shown in FIG. 6 and tG12.

On the basis of the results of measurements (H, L, $Z_1$) as shown in FIG. 6 and expression (1), a distance tG12 from the upper surface of the first electrode 3 to the lower surface of the second electrode 4 can be found according to the following expression (3). FIG. 9 is an explanatory view diagrammatically showing relationships between the values shown in FIG. 6 and tG12.

$$tG12=(Z_1-Z_0)-(L-L_0)-(H-H_0)+T_0 \quad (3)$$

An interval G12 between a lower surface of the first electrode 3 and an upper surface of the second electrode 4 can be found by the following expression (4) depending upon a thickness $t_1$ of the first electrode 3 and a thickness $t_2$ of the second electrode 4. Here, it is to be noted that $t_1$ and $t_2$ are measured in the stage in which the first electrode 3 and second electrode 4 are left as discrete component parts before assembly of the electron gun assembly 24.

$$G12=tG12-t_1-t_2 \quad (4)$$

Figure 10:
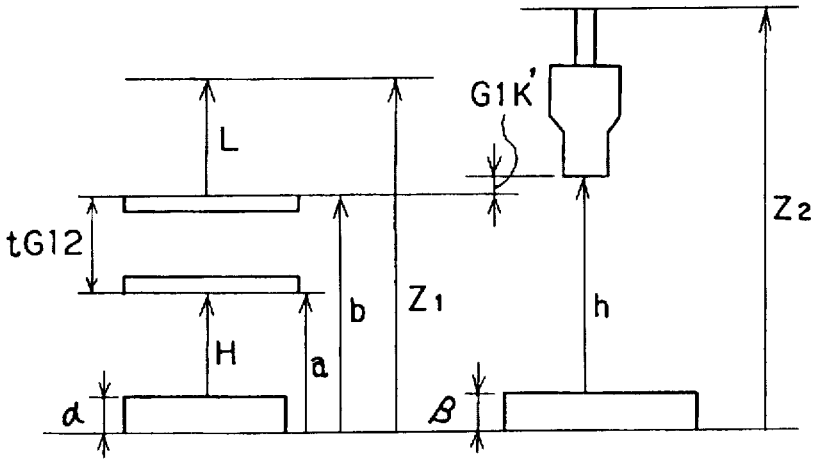
FIG. 10 is an explanatory view diagrammatically showing a relationship between measured values shown in FIGS. 6 and 8 and G1K'.

Next, on the basis of the results of measurements (L, $Z_1$, h) as shown in FIGS. 6 and 8 and expression (2), a distance G1K' between the surface of the cathode 1 and the upper surface of the first electrode 3 can be found by the following expression (5). FIG. 10 is an explanatory view diagrammatically showing relationships between the values shown in FIGS. 6 and 8 and G1K'.

$$G1K'=(Z_0'-Z_1)-(h_0-h)-(L_0'-L)-t_0 \quad (5)$$

Subsequently, a target value G1Km is calculated by using G12 found by the expression (4) as the optimal value of a distance (G1K interval) between the surface of the cathode 1 and the upper surface of the first electrode 3. In order to optimize the cut-off voltage characteristic of an electron gun, it is necessary to set the G1K interval according to G12 which is the interval between the first electrode 3 and the second electrode 4 in the electron gun assembly 24. Consequently, a predetermined mathematical expression is used to calculate the optimal G1K interval depending upon the value G12 by using data on the diameters of the electron through-holes and thickness of the first electrode 3. The arithmetic device 42 calculates the target value G1Km by substituting G12 found by the expression (4) in the mathematical expression.

In order to position the supporting member 15 holding the cathode holding member 10 with respect to the vertical direction so that the distance between the cathode 1 and the upper surface of the first electrode 3 is set to the target value G1Km, the arithmetic device calculates a target position Zm of the vertically driving mechanism 12 positioning the supporting member 15 on the basis of the difference between the target value G1Km and G1K' found by the expression (5), and the measured value $Z_2$ of the position of the vertically driving mechanism 12, using the following equation (6).

$$Zm=Z_2+(G1Km-G1K') \quad (6)$$

Thus, the cathode 1 secured to the free end of the cathode holding mechanism 10 can be correctly positioned at its target position at a time of insertion of the cathode 1 into the electron gun assembly 24.

Figure 12:
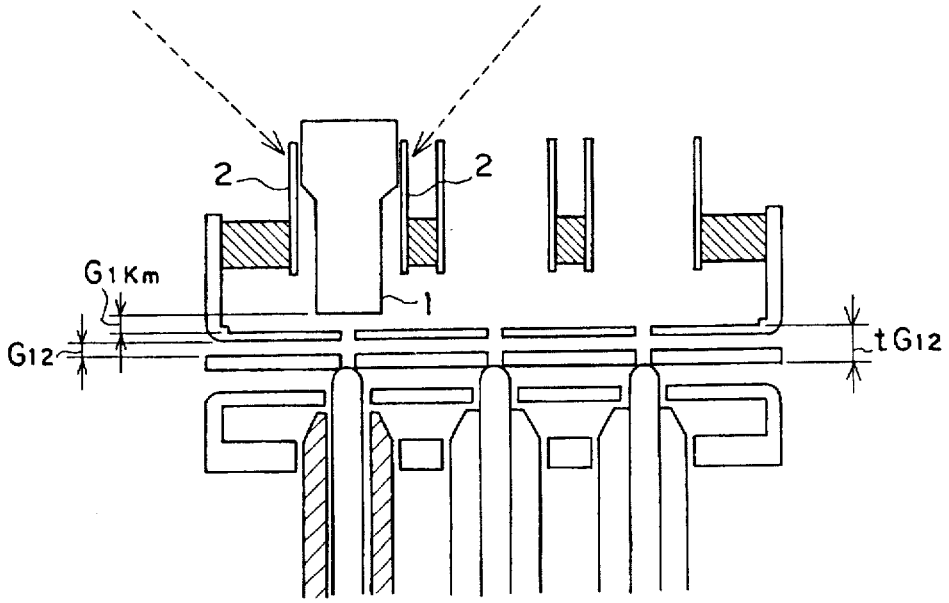
FIG. 12 is an enlarged view of a B portion of FIG. 11.
Figure 11:
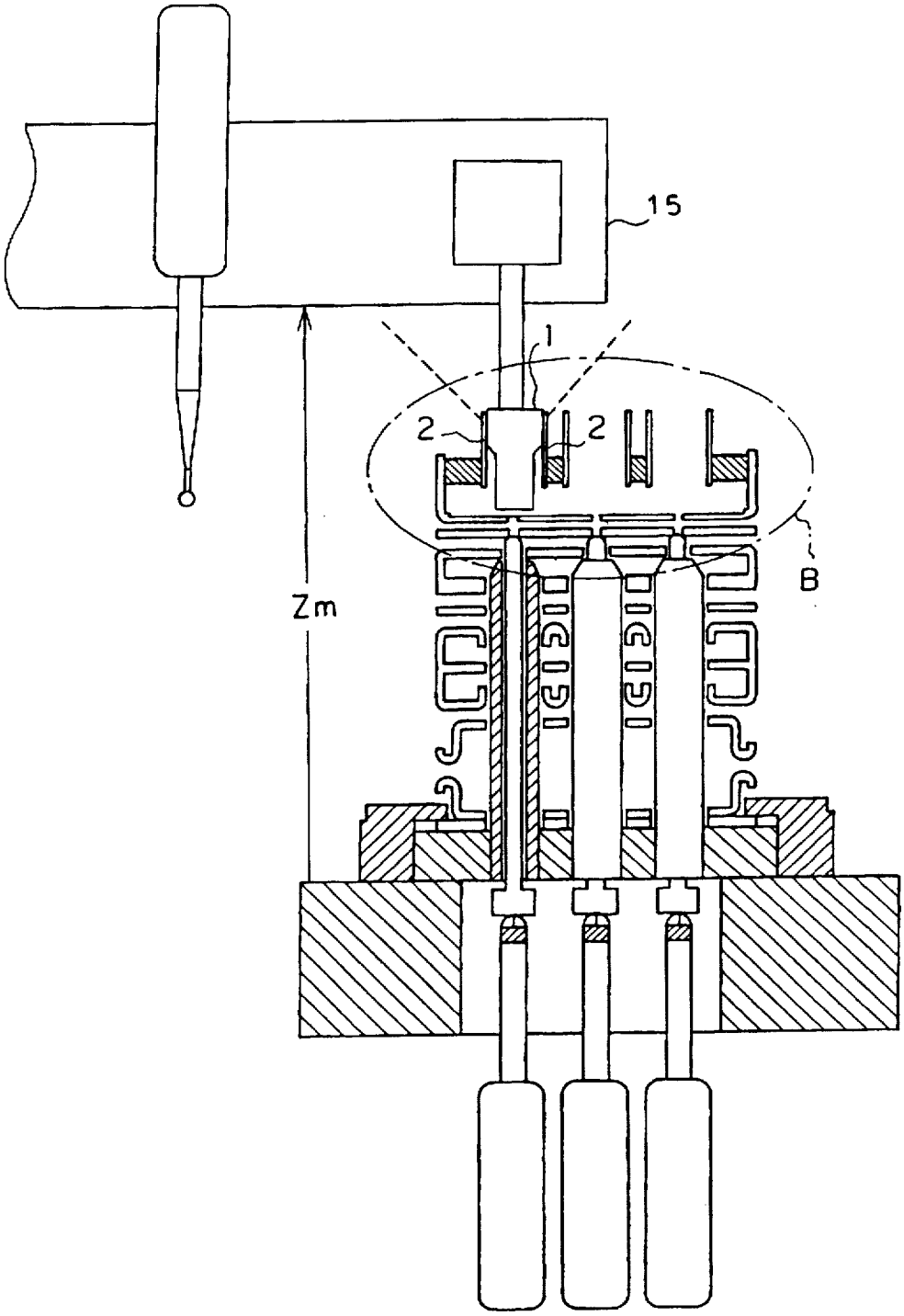
FIG. 11 is a schematic diagram showing the act of inserting a cathode according to the embodiment of the present invention.
Figure 13:
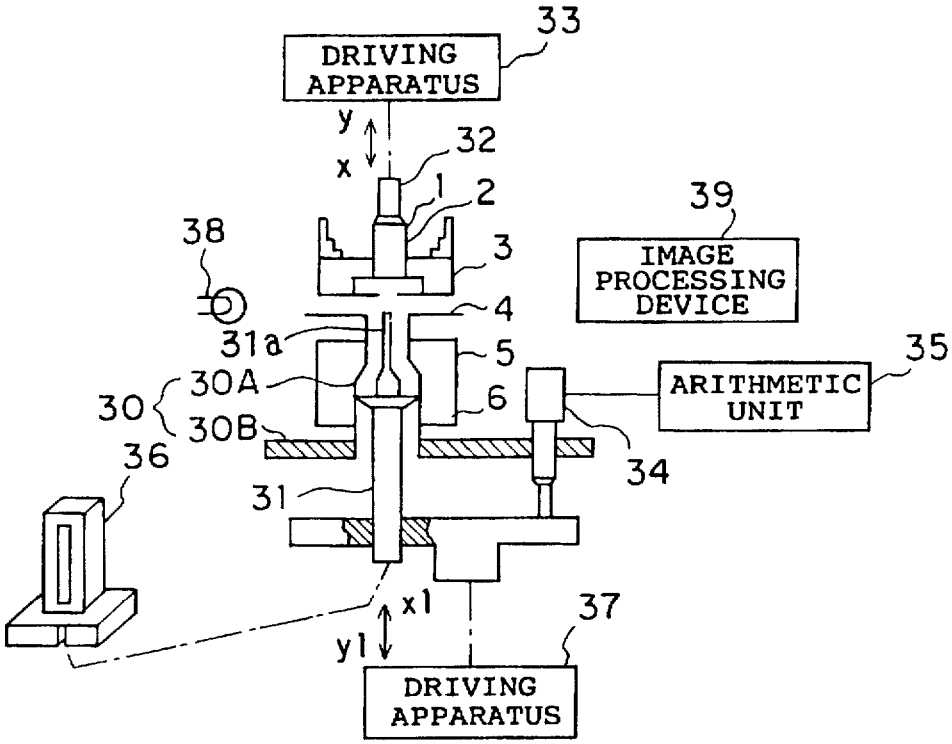
FIG. 13 (PRIOR ART)
FIG. 13 is a schematic diagram showing a conventional electron gun assembling apparatus and a method of assembling an electron gun disclosed in Japanese Patent Publication No. 2-27635.
Figure 14:
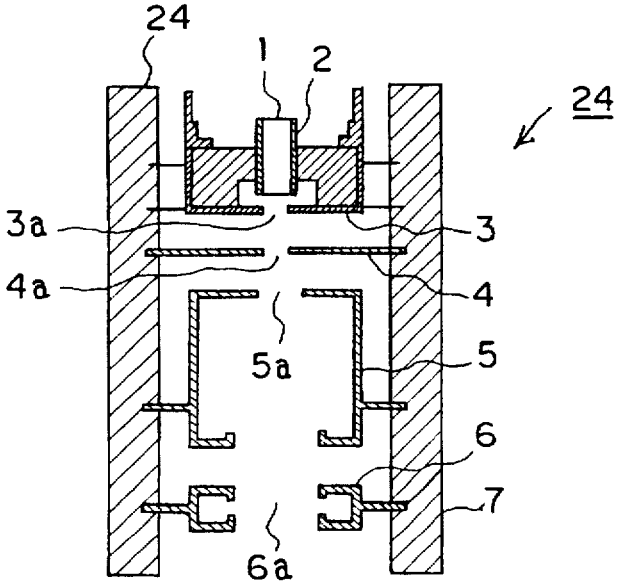
FIG. 14 (PRIOR ART)
FIG. 14 is a sectional view showing a state in which a cathode is attached to an electron gun assembly in the conventional electron gun assembling apparatus.

FIG. 11 is a schematic diagram showing the act of inserting the cathode, and FIG. 12 is an enlarged view of a B portion thereof. Following the completion of the measurement of height of the cathode 1, the control device 43 controls the vertically driving mechanism 12 and XY driving mechanism 13 so as to move the cathode holding mechanism 10 holding the cathode 1 to a position above the cathode support 2 into which the cathode 1 is to be inserted. Then, the control device 43 controls the vertically driving mechanism 12 so that the vertically driving mechanism 12 drives the cathode holding mechanism 10 as far as the surface of the cathode 1 is located at the target position Zm found as described above, and hence the cathode 1 is inserted into and positioned in the cathode support up to the optimal height. Finally, the cathode 1 is fixed to the cathode support 2 by a method such as welding, resulting in completion of the assembling operation.

As set forth above, according to the embodiment, it is possible to independently measure the height of the surface of the cathode 1 in a state in which the cathode 1 is not inserted into the electron gun assembly 24, and, after that, keep track of the height of the surface of the cathode 1 carried by the vertically driving mechanism 12 on the basis of an amount of variation in height measured by the vertically driving mechanism 12. Furthermore, the height of the first electrode 3 can be measured on the upper surface of the first electrode 3. Consequently, the G1K interval can directly be determined by calculation without, for example, the thickness of the first electrode 3. Therefore, by the determination of the G1K interval, which must more exactly be made than the measurement of the G12 interval, the electron gun assembling apparatus of the embodiment can assemble the electron gun with the accurate G1K interval without effects due to, for example, a variation in thickness of the first electrode 3. Furthermore, unlike the prior art, it is not necessary to pass the nozzle of the air micrometer through the small electron through-holes in the first and second electrodes in the measurement of the height of the surface of the cathode 1. As a result, it is possible to measure the height of the surface of the cathode 1 without causing a measurement error due to the small nozzle diameter of the air micrometer, and assemble the electron gun with the accurate G1K interval even in assembly of an electron gun for the high-resolution cathode ray-tube having excellent focus characteristic and including the extremely small electron through-holes in the first and second electrodes.

Furthermore, the height of the surface of the cathode 1 is measured by scanning the surface at the position thereof measured by the laser displacement gage 14, and the height of the surface of the cathode 1 is determined from the mean value of the plurality of measured values. Therefore, it is possible to measure the height of the cathode surface with causing no measurement error and with high accuracy as compared with the measurement of the height of the surface of the cathode 1 by the conventional air micrometer to measure by passing the nozzle through the small electron through-holes in the first and second electrodes. Furthermore, it is possible to make the setting of the G1K interval with high accuracy even in assembly of the electron gun for the high-resolution cathode ray-tube having excellent focus characteristic and including the extremely small electron through-holes in the first and second electrodes.

Furthermore, the heights of the first electrode 3 and second electrode 4 are measured in the contact manner by the electric micrometers 8 and 11 with the probe distal ends having the radius of curvature of 20 mm or more, and the contact force of 20 g or less to the electrodes during the measurement. Therefore, as compared with the conventional measurement of the heights of the first and second electrodes by recognition of the silhouette of a nozzle inserted into the electron through holes, it is possible to accurately and rapidly measure the heights of the electrodes without causing the measurement error due to a variation in brightness of the light source which yields the silhouette, or shadow of dust, and without damage to the electrodes by the probe distal ends.

Furthermore, it is possible to measure the height of the second electrode 4 by passing the probe 8*a* of the electric micrometer 8 through the positioning shaft 9*a* inserted into the electron gun assembly 24 while the electron gun assembly 24 is positioned and fixed, and simultaneously measure the upper surface of the first electrode 3 by the electric micrometer 11. Therefore, the measurement of both the electrodes can concurrently be made in a short time, and the electron gun assembling apparatus can be made smaller.

Furthermore, the electric micrometer 11 serving as the first electrode upper surface measuring device and the cathode holding mechanism 10 are supported by the common supporting body 15, and are driven in common by the vertically driving mechanism 12 for moving the supporting body 15. In addition, the upper surface of the first electrode 3 and surface of the cathode 1 are measured by drive of the common vertically driving mechanism 12. That is, the vertically driving mechanism 12 has a common origin for the measurements. As a result, it is possible to make highly accurate measurement by simple calibration, and make the electron gun assembling apparatus smaller.

Furthermore, there are disposed the reference jigs 16 and 17 having the known thicknesses, to calibrate the measuring devices, i.e., the electric micrometer 8, electric micrometer 11, laser displacement gage 14 and supporting body height measuring device 41, and a reference jig driving mechanism such as the driving mechanism 18 for moving the reference jigs 16 and 17 between the measuring positions of the measuring devices and the standby positions. The calibration using the reference jigs 16 and 17 are made periodically, for example, per hour. Thus, it is possible to make highly accurate measurements without a cause of the error between the measuring devices due to variations with time such as a variation in ambient temperature, thereby setting the G1K interval with high accuracy.

Therefore, according to the aforementioned embodiment, the electron gun assembling apparatus having a compact structure can position and fix the cathode 1 by correctly setting the G1K interval for the electron gun assembly 24. It is thereby possible to rapidly manufacture the electron gun having optimal cut-off voltage characteristic even in assembly of the electron gun for the high-resolution cathode ray-tube having excellent focus characteristic and including smaller electron through-holes in the first and second electrodes as well as a conventional electron gun for a cathode-ray tube.

In the embodiment mentioned above, the position h of the surface of the cathode 1 is determined from the mean value of many measured values obtained by the scanning. However, instead of the mean value, it is also possible to use a statistically obtained value such as the maximum value, a mode in a frequency distribution, or a central value in a frequency distribution. Furthermore, though the laser displacement gage 14 is used for the measurement of the height of the surface of the cathode 1 in the above-mentioned embodiment, another measuring apparatus may be used as the cathode surface measuring device as long as the apparatus can measure the height of the surface of the cathode 1 in the non-contact manner. Furthermore, though the lower surface position of the second electrode 4 is measured in the measurement of the position of the second electrode 4, an upper surface position may be measured if possible. In this case, the measured value $t_2$ of the thickness of the second electrode 4 is not required for the calculation of G12 in the expression (4).

As set forth above, according to the present invention, there are provided an electron gun assembling apparatus comprising an electron gun assembly holding mechanism for holding an electron gun assembly with a plurality of electrodes supported by an insulating glass at predetermined intervals except a cathode, a cathode holding mechanism for holding the cathode, a cathode driving mechanism for moving the cathode holding mechanism and cathode, a cathode surface measuring device for measuring the height of a cathode surface in a non-contact manner at a cathode surface measuring position outside the electron gun assembly, a first electrode upper surface measuring device for measuring the height of the upper surface of a first electrode in the electron gun assembly held by the electron gun assembly holding mechanism, a second electrode measuring device for measuring the height of a second electrode in the electron gun assembly held by the electron gun assembly holding mechanism, an arithmetic device for calculating an interval between the first electrode and the second electrode of the electron gun assembly by using, for example, measured values obtained by the first electrode upper surface measuring device and second electrode measuring device, and the measured and known thickness of the first electrode, and for calculating the optimal value of an interval between the first electrode and the cathode which depends on the interval between the first and second electrodes, by using data about electron through-hole diameters and so on, and a control device for controlling the cathode driving mechanism to insert the cathode into the electron gun assembly until the optimal value is reached by a difference between the height of the cathode surface at the cathode assembling position, which is obtained by adding an amount of variation in the height of the cathode caused by the cathode driving mechanism to the height of the cathode surface at the cathode surface measuring position measured by the cathode surface measuring device, and the height of the first electrode upper surface. It is possible to independently measure the height of the cathode surface in a state in which the cathode is not inserted into the electron, and, after that, keep track of the height of the cathode carried by the cathode driving mechanism on the basis of a variation in the height of the cathode driving mechanism, and make a measurement of the height of the upper surface of the first electrode. Thus, the present invention offers an advantage in that the G1K interval can directly be determined by calculation without having to use, for example, the thickness of the first electrode. Therefore, by the determination of the G1K interval, which must more exactly be made than the measurement of the G12 interval, effects due to, for example, a variation in thickness of the first electrode can be eliminated to provide the accurate G1K interval, and an electron gun having optimal cut-off voltage characteristic can stably be assembled. Furthermore, unlike the prior art, it is not necessary to pass the nozzle of an air micrometer through the small electron through-holes in the first and second electrodes in the measurement of the height of the cathode surface. As a result, the present invention provides advantages in that the height of the cathode surface can be measured without causing a measurement error due to the small nozzle diameter of the air micrometer, the accurate G1K interval can be set, and the electron gun having optimal cut-off voltage characteristic can be manufactured even in assembly of the electron gun for the high-resolution cathode ray-tube having excellent focus characteristic and including the extremely small electron through-holes in the first and second electrodes.

According to the present invention, there are provided electric micrometers each having a probe, a distal end of which is formed to have a convex curved surface, as the first electrode upper surface measuring device and second electrode measuring device. The heights of the electrodes can directly be measured in a contact manner. Therefore, the present invention offers an advantage in that, as compared with conventional measurement of the heights of the first and second electrodes by recognition of the silhouette of a nozzle inserted into the electron through holes, it is possible to accurately and rapidly measure the heights of the electrodes without causing a measurement error due to a variation in brightness of the light source which yields the silhouette, or shadow of dust, and without damage to the electrodes by the probe distal ends.

According to the present invention, each of the probe distal ends of the electric micrometers have a radius of curvature of 20 mm or more, and a contact force of 20 g or less during measurement. Therefore, the present invention provides advantages in that the first and second electrodes are not deformed and damaged during the measurement, and the interval between the first and second electrodes can be measured with high accuracy.

According to the present invention, the electron gun assembly holding mechanism has a positioning shaft to be inserted into the electron through-holes in the electron gun assembly, and the probe of the electric micrometer serving as the second electrode measuring device can be inserted into the inside of the positioning shaft. Consequently, it is possible to measure the height of the second electrode by passing the probe of the electric micrometer through the positioning shaft with the electron gun assembly positioned and fixed by inserting the positioning shaft into the electron through-holes in the electron gun assembly, and simultaneously measure the upper surface of the first electrode by the electric micrometer. Thus, the present invention offers advantages in that the first electrode and second electrodes can simultaneously be measured in a short time, and the electron gun assembling apparatus can be made smaller.

According to the present invention, the electric micrometer serving as the first electrode upper surface measuring device and cathode holding mechanism are supported by a common supporting body, and are driven in common by the cathode driving mechanism for moving the supporting body. Thus, the present invention offers advantages in that, since the measurements of the first electrode upper surface and cathode surface can be made by only drive of the common cathode driving mechanism, and hence the driving mechanism can provide a common origin for the measurements, the measurements can be made with high accuracy by performing a simple calibration for the measuring devices, and the electron gun assembling apparatus can be made smaller.

According to the present invention, there is provided a laser displacement gage as the cathode surface measuring device. The present invention offers an advantage in that, as compared with a measurement of the height of the cathode surface made by a conventional air micrometer by passing a nozzle through the small electron through-holes in the first and second electrodes, the measurement of the height of the cathode surface can extremely rapidly be made with high accuracy without causing a measurement error. Another advantage is that, even in assembly of an electron gun for a high-resolution cathode ray-tube having excellent focus characteristic and including extremely small electron through-holes in the first and second electrodes, the G1K interval can be set to an optimal value with high accuracy, and an electron gun having optimal cut-off voltage characteristic can rapidly be manufactured.

According to the present invention, the cathode driving mechanism or laser displacement gage is constructed so as to scan the surface of the cathode in order to vary the measuring position where the laser displacement gage measures the height of the cathode surface. Thus, the present invention offers advantages in that the height of the cathode is repeatedly measured at a plurality of measuring points by scanning the measuring position on the cathode surface, and the height of the cathode surface can accurately be determined by using the plurality of measurement values obtained so as to set the G1K interval with high accuracy, and manufacture an electron gun having optimal cut-off voltage characteristic.

According to the present invention, there are provided a first and second reference jigs each having a predetermined thickness, for calibration between the first electrode upper surface measuring device, second electrode measuring device, cathode surface measuring device, and cathode position measuring device, and a reference jig driving mechanism for moving the reference jigs between measuring positions of the measuring devices and standby positions. Thus, the present invention offers advantages in that a highly accurate measurement can be made by the calibration effectively and easily using the reference jigs without a cause of an error between the measuring devices due to causes such as a variation in ambient temperature, thereby setting the G1K interval with high accuracy, and an electron gun having the optimal cut-off voltage characteristic can be manufactured.

According to the present invention, there is provided a method comprising the steps of measuring the height of a cathode surface in a non-contact manner at a cathode surface measuring position outside an electron gun assembly; measuring the height of a first electrode upper surface of the electron gun assembly; measuring the height of a second electrode of the electron gun assembly; determining the interval between the first and second electrodes in the electron gun assembly by using, for example, the measured height of the first electrode upper surface and measured height the second electrode, and the measured and known thickness of the first electrode; calculating the optimal value of the interval between the first electrode and the cathode which depends on the found interval between the first and second electrodes by using data about electron through-hole diameters and so on; moving the cathode from the cathode surface measuring position to a cathode assembling position where the cathode is to be incorporated into the electron gun assembly; and positioning and fixing the cathode by inserting the cathode into the electron gun assembly until the optimal value is reached by a difference between the height of the cathode surface at the cathode assembling position, which is obtained by adding an amount of variation in the height of the cathode caused by the above movement of the cathode to the height of the cathode surface at the cathode surface measuring position, and the height of the first electrode upper surface. It is possible to independently measure the height of the cathode surface in a state in which the cathode is not inserted into the electron gun assembly, and, after that, keep track of the height of the cathode surface on the basis of an amount of variation in the height of the cathode by means of the cathode driving mechanism, and make a measurement of the height of the first electrode on the upper surface. Consequently, the present invention offers an advantage in that the G1K interval can directly be determined by a calculation without having to use, for example, the thickness of the first electrode. Therefore, in the determination of the G1K interval, which must more exactly be made than the measurement of the G12 interval, effects due to, for example, a variation in the thickness of the first electrode can be eliminated to set the G1K interval to an optimal value. Thereby, an electron gun having optimal cut-off voltage characteristic can stably be assembled. Furthermore, unlike the prior art, it is not necessary to pass the nozzle of an air micrometer through the small electron through-holes in the first and second electrodes in the measurement of the height of the cathode surface. Thus, the present invention offers advantages in that the height of the cathode surface can be measured without causing a measurement error due to the small nozzle diameter of the air micrometer, even in assembly of the electron gun for the high-resolution cathode ray-tube having excellent focus characteristic and including the extremely small electron through-holes in the first and second electrodes, the G1K interval can accurately be set to the optimal value, and the electron gun having optimal cut-off voltage characteristic can be manufactured.

According to the present invention, a contact type electric micrometer is used to measure the height of the first electrode upper surface and height of the second electrode in the electron gun assembly. Thus, the present invention offers an advantage in that, as compared with measurements of the heights of the first and second electrodes by recognition of the silhouette of a nozzle inserted into the electron through-holes, it is possible to accurately and rapidly measure the heights of the electrodes without causing a measurement error due to a variation in the brightness of the light source which yields the silhouette, or shadow of dust.

According to the present invention, a laser displacement gage is used to measure the height of the surface of the cathode at a cathode surface measuring position in a non-contact manner. Therefore, the present invention offers an advantage in that, as compared with a measurement of the height of the cathode surface made by a conventional air micrometer by passing a nozzle through the small electron through-holes in the first and second electrodes, the measurement of the height of the cathode surface can extremely rapidly be made with high accuracy without causing a measurement error. Another advantage is that, even in assembly of an electron gun for a high-resolution cathode ray -tube having excellent focus characteristic and including extremely small electron through-holes in first and second electrodes, the G1K interval can be set to an optimal value with high accuracy, and an electron gun having optimal cut-off voltage characteristic can rapidly be manufactured.

According to the present invention, the cathode surface is scanned at a time of measurement by the laser displacement gage, and a value statistically found from an aggregation of obtained measured values is defined as the height of the cathode surface. Thus, the present invention offers advantages in that the value statistically found from the aggregation of the obtained measured values can be used to accurately determine the height of the cathode surface so as to set the G1K interval to an optimal value with high accuracy, and an electron gun having optimal cut-off voltage characteristic can be manufactured.

According to the present invention, a mean value is used as the value statistically found from the aggregation of measured values. Thus, the present invention offers advantages in that, by calculating the mean value of the plurality of measurement values obtained, the height of the cathode surface can accurately be determined to set the G1K interval to an optimal value with high accuracy, and an electron gun having optimal cut-off voltage characteristic can be manufactured.

According to the present invention, a calibration is periodically made between measuring devices for carrying out position measurements on the upper surface of the first cathode, second electrode, and surface of the cathode. Thus, the present invention offers advantages in that a highly accurate measurement can be made without a cause of an error in the measuring devices and assembling mechanisms due to variations with time, the G1K interval can thereby be set to an optimal value with high accuracy, and an electron gun having optimal cut-off voltage characteristic can be manufactured.

Many widely different embodiments of the present invention may be constructed without departing from the spirit and scope of the present invention. It should be understood that the present invention is not limited to the specific embodiments described in the specification, except as defined in the appended claims.

What is claimed is:

1. A method of assembling an electron gun, for positioning and fixing a cathode to an electron gun assembly in which at least first and second electrodes are supported by an insulating glass and are arranged at a predetermined interval, said method comprising the steps of: measuring a position of a surface of said cathode at a cathode surface measuring position outside said electron gun assembly;

measuring a position of an upper surface of said first electrode in said electron gun assembly;

measuring a position of said second electrode in the electron gun assembly;

determining an interval between said first electrode and said second electrode in said electron gun assembly on the basis of at least the measured positions of the upper surface of said first electrode and said second electrode, and a measured and known thickness of said first electrode;

calculating an optimal value of an interval between said first electrode and said cathode, which depends on the interval between said first electrode and said second electrode;

moving said cathode from the cathode surface measuring position to a cathode assembling position where said cathode is incorporated into said electron gun assembly;

determining a current position of the surface of said cathode from the position of the surface of said cathode at the cathode surface measuring position and a variation in position of the surface of said cathode which is caused by a movement of said cathode to the cathode assembling position; and positioning and fixing said cathode by inserting said cathode into said electron gun assembly until a difference between the current position of the cathode surface and the position of the first electrode upper surface reaches the optimal value calculated.

2. The method of assembling an electron gun according to claim 1, wherein the step of measuring the position of said second electrode is performed by measuring a lower surface of said second electrode, and the interval between said first electrode and said second electrode in said electron gun assembly is determined on the basis of the positions of the upper surface of said first electrode and lower surface of said second electrode, and measured and known thicknesses of said first and second electrodes.

3. The method of assembling an electron gun according to claim 1, wherein a calibration is periodically made to obtain a relationship between measured values in the steps for measuring the positions of the upper surface of said first electrode, said second electrode, and surface of said cathode at the cathode surface measuring position.

4. The method of assembling an electron gun according to claim 1, wherein a contact type electric micrometer is used to measure the position of the upper surface of said first electrode and the position of said second electrode in said electron gun assembly.

5. The method of assembling an electron gun according to claim 1, wherein a laser displacement gage is used to measure the position of the surface of said cathode at the cathode surface measuring position.

6. The method of assembling an electron gun according to claim 5, wherein the surface of said cathode is scanned at a time of measurement by said laser displacement gage, and a value statistically found from an aggregation of measured values obtained by the scanning is defined as the position of the surface of said cathode.

7. The method of assembling an electron gun according to claim 6, wherein a mean value is used as the value statistically obtained from the aggregation of the measured values.

8. An electron gun assembling apparatus comprising:

an electron gun assembly holding means for holding an electron gun assembly including at least first and second electrodes which are supported by an insulating glass and are arranged vertically at a predetermined interval;

a cathode holding means for holding a cathode to be incorporated into said electron gun assembly;

a cathode driving means for moving said cathode holding means to transport said cathode until said cathode is mounted in said electron gun assembly;

a cathode surface measuring means for measuring a position of a surface of said cathode which is held by said cathode holding means and is located outside said electron gun assembly;

a first electrode upper surface measuring means for measuring a position of an upper surface of said first electrode in said electron gun assembly held by said electron gun assembly holding means;

a second electrode measuring means for measuring a position of said second electrode in said electron gun assembly held by said electron gun assembly holding means;

a cathode position measuring means for measuring a variation in position of the surface of said cathode held by said cathode holding means carried by said cathode driving means;

an arithmetic means for determining an interval between said first electrode and said second electrode in said electron gun assembly on the basis of at least position information obtained by said first electrode upper surface measuring means and said second electrode measuring means, and a measured and known thickness of said first electrode, and for calculating an optimal value of an interval between said first electrode and said cathode, which depends on the interval between said first electrode and said second electrode; and a control means for determining a current position of the surface of said cathode from the position of the surface of said cathode measured by said cathode surface measuring means and a variation in position of the surface of said cathode obtained by said cathode position measuring means, and for controlling said cathode driving means to insert said cathode into said electron gun assembly until a difference between the current position of the cathode surface and the position of the first electrode upper surface reaches the optimal value calculated by said arithmetic means.

9. The electron gun assembly apparatus according to claim 8, wherein said second electrode measuring means is a means for measuring a position of a lower surface of said second electrode, and said arithmetic means determines the interval between said first electrode and said second electrode in said electron gun assembly on the basis of position information obtained by said first electrode upper surface measuring means and said second electrode measuring means, and measured and known thicknesses of said first and second electrodes.

10. The electron gun assembling apparatus according to claim 8, wherein each of said first electrode upper surface measuring means and said second electrode measuring means is an electric micrometer with a probe, a distal end of which is formed to have a convex curved surface.

11. The electron gun assembling apparatus according to claim 10, wherein the probe distal end of each of the electric micrometers has a radius of curvature of 20 mm or more, and a contact force of 20 g or less during measurement.

12. The electron gun assembling apparatus according to claim 10, wherein said electron gun assembly holding means has a positioning shaft which is inserted into electron through-holes in said electron gun assembly, and into which the probe of the electric micrometer serving as said second electrode measuring means can be inserted.

13. The electron gun assembling apparatus according to claim 8, wherein said cathode surface measuring means is a laser displacement gage.

14. The electron gun assembling apparatus according to claim 13, wherein said cathode driving means includes a means for moving said cathode holding means to enable scanning of a measuring position on the cathode surface when the position of the surface of said cathode is measured by said laser displacement gage.

15. The electron gun assembling apparatus according to claim 13, wherein said laser displacement gage includes a means for scanning a measuring position on the surface of said cathode when said laser displacement gage measures the position of the surface of said cathode.

16. The electron gun assembling apparatus according to claim 8, wherein said apparatus further comprises a supporting body, which is driven by said cathode driving means, for supporting said first electrode upper surface measuring means and said cathode holding means.

17. The electron gun assembling apparatus according to claim 16, wherein said cathode position measuring means is a means for measuring a position of said supporting body.

18. The electron gun assembling apparatus according to claim 17, further comprising a reference jig means for determining a relationship between measured values obtained by said first electrode upper surface measuring means, said second electrode measuring means, said cathode surface measuring means, and said cathode position measuring means to calibrate these measuring means, and a reference jig driving means for moving said reference jig means between measuring positions where said reference jig means is measured by said plural measuring means and standby positions where said reference jig means is apart from said plural measuring means.

19. The electron gun assembling apparatus according to claim 18, wherein said reference jig means includes a first reference jig with a predetermined thickness for determining a relationship between measured values obtained by said first electrode upper surface measuring means, said second electrode measuring means and said cathode position measuring means, and a second reference jig with a predetermined thickness for determining a relationship between measured values obtained by said cathode surface measuring means and said cathode position measuring means.

* * * * *